US007487818B2

(12) United States Patent
Zimmer

(10) Patent No.: US 7,487,818 B2
(45) Date of Patent: Feb. 10, 2009

(54) WINDOW ORIGAMI PANELS AND THE LIKE

(76) Inventor: Robyn A. Zimmer, 97 Roycroft, Snyder, NY (US) 14226

( * ) Notice: Subject to any disclaimer, the term of this patent is extended or adjusted under 35 U.S.C. 154(b) by 11 days.

(21) Appl. No.: 11/406,036

(22) Filed: Apr. 18, 2006

(65) Prior Publication Data

US 2006/0289130 A1 Dec. 28, 2006

Related U.S. Application Data

(60) Provisional application No. 60/672,333, filed on Apr. 18, 2005.

(51) Int. Cl.
*A47H 13/14* (2006.01)

(52) U.S. Cl. ..... 160/348; 160/124; 160/405

(58) Field of Classification Search ..... 160/368.1, 160/330, 348, 349.1, 349.2, 123, 124, 126, 160/84.01, 38, 127, 327, 405
See application file for complete search history.

(56) References Cited

U.S. PATENT DOCUMENTS

| | | | | |
|---|---|---|---|---|
| 534,828 A | | 2/1895 | Hensel | |
| 1,516,935 A | * | 11/1924 | Wachtel | 112/475.06 |
| 2,627,918 A | | 2/1953 | Gordon | |
| 2,671,508 A | | 3/1954 | Gordon | |
| 2,779,405 A | | 1/1957 | Hess | |
| 3,480,069 A | * | 11/1969 | Handwerker | 160/354 |
| 3,545,085 A | * | 12/1970 | Stewart | 33/12 |
| 3,759,398 A | * | 9/1973 | Romney | 211/46 |
| 3,896,931 A | * | 7/1975 | Franklin | 206/326 |
| 4,391,865 A | * | 7/1983 | Constance | 428/74 |
| 4,739,815 A | | 4/1988 | Altman | |
| 4,747,442 A | | 5/1988 | Bade | |
| 5,010,944 A | * | 4/1991 | Bussert | 160/354 |

(Continued)

FOREIGN PATENT DOCUMENTS

JP 2006-042964 A 2/2006

(Continued)

OTHER PUBLICATIONS

J. Bolsover et al, Windowstyling, 2000, pp. 64-66 and 1 page titled "hooked Panel Blind", Conrad Octopus Limited, London.

(Continued)

*Primary Examiner*—David Purol
(74) *Attorney, Agent, or Firm*—James C. Simmons

(57) ABSTRACT

A plurality of holes or other fastener elements are equally spaced along all of the edge portions of a curtain panel to connect to similarly equally spaced protrusions or other mating fastener elements on a curtain rod sleeve or other structural member in order to provide curtains which can effectively and aesthetically, as well as easily and quickly, be arranged in a variety of alternative decorative patterns. In another aspect, the panel is connected along one edge to a curtain rod sleeve which has fastener elements, and mating fastener elements are spaced along the remainder of the perimeter of the panel. In order to hang a curtain in a desired one of alternative decorative patterns, fastener elements on each of adjoining perimetric edge portions of the curtain are connected to mating fastener elements on a curtain rod sleeve or other structural member.

20 Claims, 4 Drawing Sheets

U.S. PATENT DOCUMENTS

| | | | | |
|---|---|---|---|---|
| 5,109,908 | A | 5/1992 | Chen | |
| 5,127,460 | A | 7/1992 | Abadi et al. | |
| 5,146,972 | A | 9/1992 | Tacchella | |
| 5,191,922 | A | 3/1993 | Wade | |
| 5,738,159 | A | 4/1998 | O'Brien | |
| 5,755,545 | A | 5/1998 | Banks | |
| 5,803,144 | A | 9/1998 | Ives | |
| 5,894,876 | A | 4/1999 | O'Brien | |
| 6,059,009 | A * | 5/2000 | Haiber | 160/330 |
| 6,142,210 | A * | 11/2000 | Isoda | 160/124 |
| 6,162,692 | A | 12/2000 | Gardner et al. | |
| 6,298,526 | B1 | 10/2001 | Baumdicker et al. | |
| 6,477,751 | B2 | 11/2002 | Baumdicker et al. | |
| 6,484,788 | B1 * | 11/2002 | Jerrell et al. | 160/330 |
| 6,662,845 | B1 | 12/2003 | Palmer | |
| 6,832,642 | B2 | 12/2004 | Titus et al. | |
| 6,923,236 | B2 | 8/2005 | Lin | |
| 2002/0029442 | A1 | 3/2002 | Baumdicker et al. | |
| 2003/0116287 | A1 | 6/2003 | Titus et al. | |
| 2003/0178161 | A1 | 9/2003 | Kuchinsky | |
| 2004/0144505 | A1 | 7/2004 | Johnson et al. | |
| 2004/0221973 | A1 * | 11/2004 | Hesse | 160/368.1 |
| 2005/0011618 | A1 | 1/2005 | Kee | |
| 2008/0011434 | A1 | 1/2008 | Tascoe | |

FOREIGN PATENT DOCUMENTS

| | | | |
|---|---|---|---|
| KR | 20-1997-0010154 | U | 3/1997 |
| KR | 20-1999-0022580 | U | 7/1999 |

OTHER PUBLICATIONS

R. Nilsson et al, Rum Att Leva I, 1991, 1 page, Utbildningsforlaget Brevskolan, Stockholm.

C. Clifton-Mogg, Curtains, 1997, 2 pages one titled "Details" and the other titled "Shades, Blinds, and Sheers," Ryland Peters & Small, London.

Porchsails.com, "Home" and "Create Your Own" worldwide web pages at prochsails.com, 2005, 2008.

* cited by examiner

FIG. 1
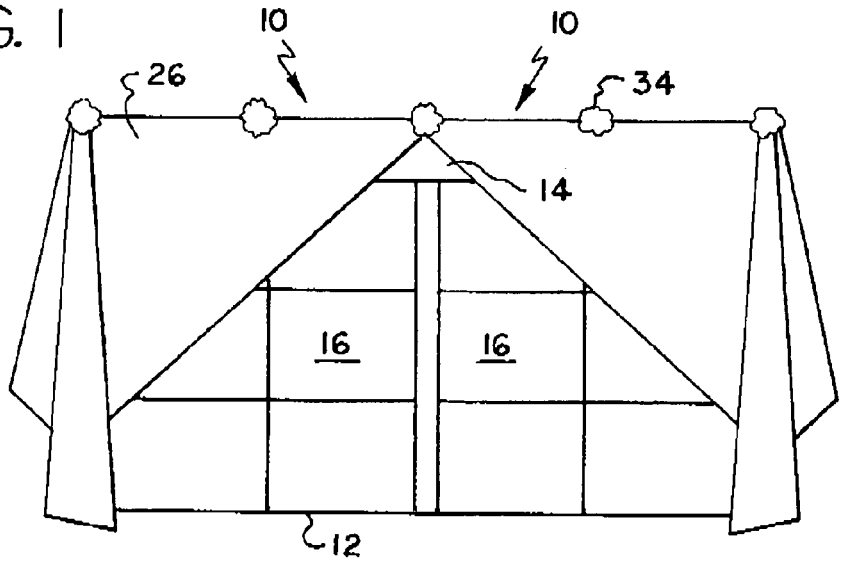
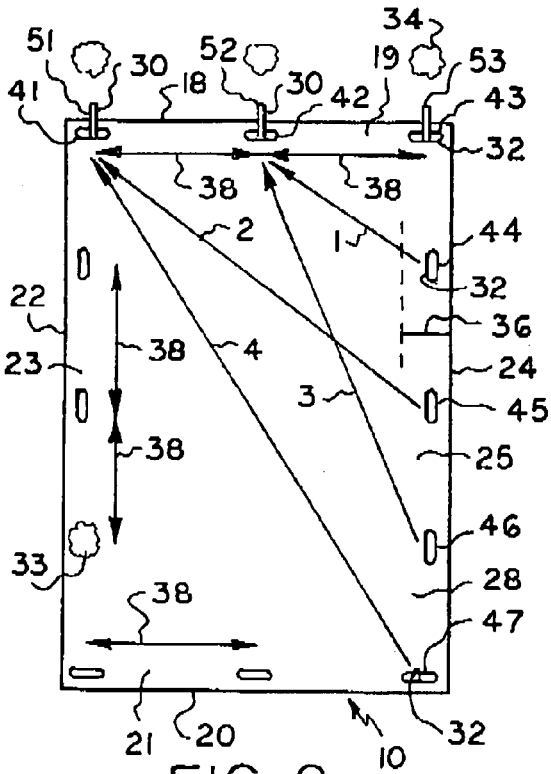
FIG. 2
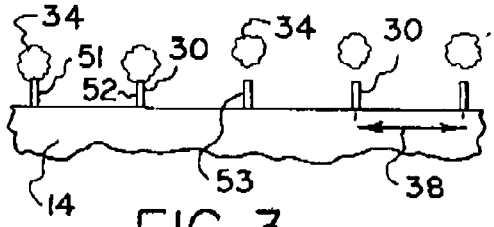
FIG. 3
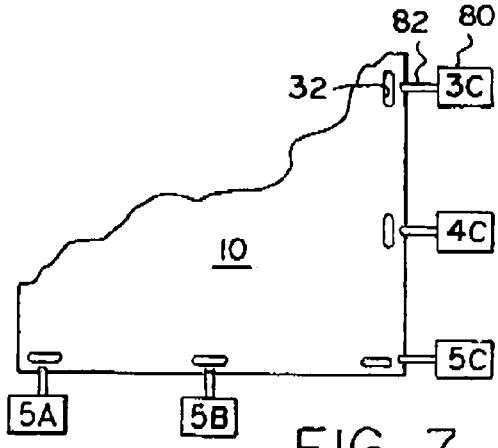
FIG. 7

WINDOW ORIGAMI PANELS AND THE LIKE

Priority of U.S. provisional patent application No. 60/672,333, filed Apr. 18, 2005, the disclosure of which is hereby incorporated herein by reference, is hereby claimed.

The present invention relates generally to window treatments, valances, draperies, hangings, or other curtains which are made of heavy fabric or other suitable material and hang from upper window frames or other suitable structural supports.

U.S. Pat. No. 6,832,642 discloses a window treatment panel which comprises a row of equally spaced buttons positioned along an upper portion thereof (adjacent a suspending sleeve or tab tops for receiving a rod) and one or more vertically spaced rows of loops, similarly equally spaced as the row of buttons, extending horizontally along the surface of thereof, resulting in loops spaced along and adjacent each of the other three side edges of the panel. Any of the rows of loops is removably securable to the row of buttons respectively to enable at least a portion of the window treatment to be raised while it is positioned over the window opening, as seen in FIG. 2 thereof, i.e., to allow a lower portion of the window treatment to be raised vertically. The loop rows are spaced at gradually increasing intervals from the bottom of the fabric panel to the top thereof. It is stated in the patent that the rows of button means and loop means may be spaced as shown in FIG. 3 or in any type of spacing to achieve any desired effect. It is further stated that the rows of button means and loop means are shown in a horizontal arrangement but that they may be arranged in various angled and arced configurations to achieve a desired visual effect. In an alternative embodiment, the buttons and loops are interchanged. U.S. published patent application 2004/0144505 is related to the above patent and discloses another embodiment thereof wherein the buttons are replaced by ties.

U.S. Pat. No. 2,627,918 discloses drapery provided on both sides of an imaginary center line with two sets of generally equally spaced eyelets in the form of rings in a pattern of curved lines symmetrically arranged on opposite sides of the center line, and the end rings are provided with lace or ribbon strings tied thereto. In order to produce pleats or folds in the drapery and the appearance shown in FIG. 2 thereof, the ribbons are inserted through all the rings of the curved lines of rings respectively and tied together. See also U.S. Pat. No. 2,671,508.

Other patents/published applications which may be considered to be of interest to the present invention include U.S. Pat. Nos. 534,828; 2,779,405; 4,739,815; 4,747,442; 5,109,908; 5,146,972; 5,191,922; 5,738,159; 5,803,144; 6,192,962; 6,662,845; and 6,923,236, and U.S. published patent applications 2003/0116287; 2003/0178161; and 2005/0011618.

The disclosures of the above patents and published applications are incorporated herein by reference.

It is considered desirable to provide curtains which may be arranged in a multitude of various origami-like decorative/functional patterns. The above references do not provide curtains which are capable, or at best are of only limited capability, of being effectively and aesthetically arranged in a multitude of alternative decorative/functional patterns.

It is accordingly an object of the present invention to provide curtain panels which can effectively and aesthetically be arranged in a multitude of alternative decorative/functional patterns.

It is another object of the present invention to provide the capability of easily and quickly re-arranging curtain panels from one decorative pattern to another.

In order to provide curtains which can effectively and aesthetically, as well as easily and quickly, be arranged in a variety of alternative decorative patterns, in accordance with the present invention, a plurality of holes or other suitable fastener elements are spaced generally along all of the edge portions of a curtain sheet to connect to hooks or buttons or other suitable mating fastener elements on a curtain rod sleeve or other structural member. In accordance with another aspect of the present invention, a plurality of holes or other suitable fastener elements are substantially equally spaced along at least two adjoining edge portions of a curtain to connect to hooks or buttons or other suitable mating fastener elements on a curtain rod sleeve or other structural member. In order to hang a curtain in a desired one of alternative decorative patterns, in accordance with the present invention, at least one first fastener element on a perimetric edge portion of the curtain is connected to a mating second fastener element on a curtain rod sleeve or other structural member and at least one first fastener element on an adjoining perimetric edge portion of the curtain is connected to a mating second fastener element.

The above and other objects, features, and advantages of the present invention will be apparent in the following detailed description of the preferred embodiment(s) thereof when read in conjunction with the accompanying drawings wherein the same reference numerals denote the same or similar parts throughout the several views.

BRIEF DESCRIPTION OF THE DRAWINGS

FIG. 1 is an elevation view of a pair of curtain sheets or panels which embody the present invention and which are shown hung from a window frame in one of a multitude of alternative decorative/functional patterns.

FIG. 2 is a plan view of one of the curtain sheets.

FIG. 3 is a partial detail view of the window frame.

FIG. 7 is a partial plan view of the curtain panel of FIG. 2.

DETAILED DESCRIPTION OF THE PREFERRED EMBODIMENT(S)

Figure 4:
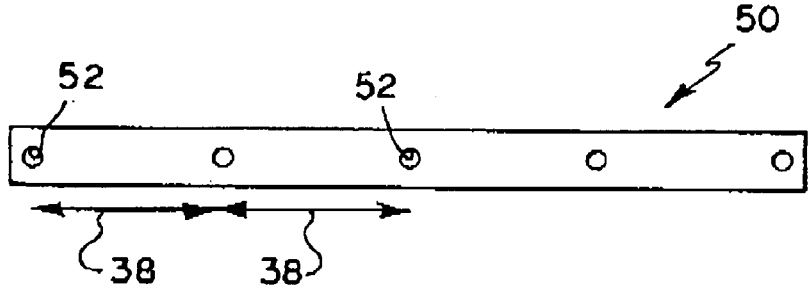
FIG. 4 is a plan view of a template for installing fastener elements for the curtains.

Referring to FIGS. 1 to 3, there is shown generally at 10 a pair of identical curtain sheets or panels serving as a window treatment for window 12. Window 12 is of conventional design, having an upper frame 14 from which the curtain sheets 10 are hung, as described hereinafter, and a plurality of suitably framed window panes 16. It should of course be understood that it is within the purview of the present invention that the window be covered by only one such curtain sheet 10 or that it be covered by more than 2 such sheets 10 (and the 2 or more curtain sheets 10 need not be identical), and that the curtain sheet or sheets 10 may be used for other hangings in addition to window hangings, for example, to hang in front of a stage at a theater or to hang from the edge of a table top or to decorate a wall or other suitable surface such as a headboard.

FIG. 2 shows one of the curtain sheets 10 to be rectangular in plan view, with opposite end edges 18 and 20 which are shown to serve as the top and bottom respectively when hung, and opposite side edges 22 and 24 which are longer than the end edges. It should be understood that the curtain 10 may be hung so that any of the edges serves as the top edge. The curtain 10 may be otherwise suitably shaped, for example, square or having a greater or lesser number of edges, and may be of any suitable size for its intended application.

Figure 14:
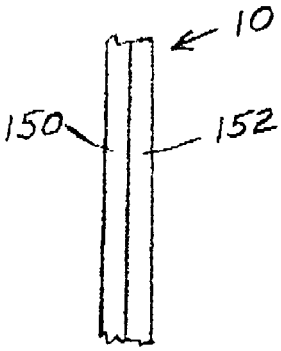
FIG. 14 is a partial enlarged edge view of a curtain sheet of FIG. 1.

The curtain is made of a suitable material, for example, a heavy fabric as is typical of curtains (although it is to be understood that a lighter fabric may be used). The fabric may be a themed fabric such as holiday or birthday themed. The curtain may be made of a single material or a plurality of materials and may be made of one or more layers of material, i.e., layers 150 and 152 illustrated in FIG. 14. Since, as will be apparent in the discussion hereinafter, portions of both sides of the curtain will be visible at the same time for many (or most) of the multitude of alternative hanging patterns, it is important that both sides 26 and 28 of the curtain be finished, that is, completed and without a lining or the like showing so that each side has the same desired pleasing appearance. The curtain 10 is therefore reversible, i.e., hung so that either side 26 or 28 faces inwardly. The curtain material is desirably washable or otherwise easily cleanable. The curtain material may also be disposable for use, for example, in hospitals or nursing homes.

The upper window frame 14 is shown in FIG. 3 to have 5 fastener elements 30 equally spaced horizontally over the length thereof. These fastener elements 30 are illustrated as pins or rods or even nails but may be otherwise suitable for fastening as hereinafter described, for example, hooks, buttons, or Velcro material. Three of the fastener elements 30 including the middle one is shown to support one of the curtain sheets on one (right) window side and three of the fastener elements 30 also including the middle one is shown to support the other curtain sheet on the other (left) window side. The number of fastener elements 30 may of course vary, but at least two fastener elements 30 will be used to support a curtain sheet. Fastener elements 30 may alternatively or additionally be positioned on the wall (such as above the window frame) or ceiling to increase the variety of alternative patterns. If desired, fastener elements 30 may be located on a curtain rod.

Each of the edges 18 and 20 defines an end perimetric edge portion 19 and 21 respectively, and each of the edges 22 and 24 of the curtain 10 defines a side perimetric edge portion 23 and 25 respectively. It is seen that edge portion 19 adjoins at one end edge portion 23 and adjoins at the other end edge portion 25, and, similarly, each of the other edge portions adjoins an edge portion at each of its ends. For the purpose of this specification and the claims, a "edge portion" is defined as a portion extending along an edge of the curtain 10 and which has a width, illustrated at 36, of up to about 6 inches or otherwise of sufficient width to adequately accommodate the fasteners elements 32 in positions adjacent (within about 1½ inch of the respective edge) the curtain edges. For example, width 36 may be about 1 inch. It is to be understood that the present invention is intended to cover curtain panels that are irregularly shaped. If such an irregularly shaped panel cannot be defined to have a pair of side edge portions and a pair of end edge portions, then, for the purposes of this specification and the claims, if the fastener elements 32 are spaced entirely around the perimeter (within the 6-inch distance from the perimeter), then they are defined as being spaced along all of the edge portions, and if they are substantially equally spaced over a continuous distance of at least half of the perimeter of the panel, then they are defined as being substantially equally spaced along at least one of the side edge portions and at least one of the end edge portions.

Spaced along the edge portions 19, 21, 23, and 25 are a plurality of fastener elements 32 which mate with fastener elements 30 for connecting thereto for hanging the curtain 10 in the desired patterns. The fastener elements 32 are arranged sufficiently along the marginal edge portions 19, 21, 23, and 25 over a sufficient length and number to allow connecting of at least two of them along one of the edge portions to respective ones of the fastener elements 30 and to connect others of the fastener elements 32 along one or more other edge portions to the fastener elements 30 to form the decorative/functional hanging arrangements which will be discussed hereinafter.

Fastener elements 32 are shown as elongate holes or slits (like button holes) which extend through the thickness of the curtain for receiving the pins 30, as illustrated in FIG. 2, but may be otherwise as suitable for mating with fastener elements 30. As long as fastener elements 30 and 32 mate with each other for fastening, they may be any suitable fastener such as, for example and without limitation, hooks, grommets including speciality-shaped grommets, bows, tabs, rings, ribbons, Velcro material, magnets, beads, or loops of material having holes therein and extending from the curtain edges or from the window frame or otherwise. The fasteners 30 and 32 may have decorative shapes. Decorative covers, illustrated at 34, may be provided to screw onto or over or otherwise fasten to the fasteners.

The fastener elements 32 are preferably button holes or otherwise unobtrusive (minimally noticeable) elements which do not unnecessarily detract from the pleasing appearance of the curtain, and fastener elements 30 are preferably pins or the like protrusions which mate with the button holes and whose outer ends can be covered with the decorative covers 34. Decorative clips, tassels, or the like may be placed in/over the holes (or other fastener elements) 32, as illustrated by decorative clip 33 in/over one of the otherwise visible holes 32 in FIG. 2, to hide the holes from view. The use of the button holes 32 and pins 30 (as well as other fastener combinations which may be provided), desirably allow the traditional curtain rod to be eliminated, thus desirably allowing the curtain 30 to be easily and quickly put up and taken down (for cleaning, etc.) as well as re-arranged into any of a multitude of various alternative patterns as hereinafter described.

The perimetric edge portions 19, 21, 23, and 25 define the entire perimeter of the curtain sheet 10, as is evident from FIG. 2. In order to allow the curtains 10 to be re-arranged into a multitude of alternative decorative/functional patterns, as hereinafter discussed, the fastener elements 32 are preferably spaced along all of the edge portions 19, 21, 23, and 25, as shown in FIG. 2, to thereby cover the entire perimeter of the curtain.

For reasons that will hereinafter be discussed, in accordance with a preferred embodiment of the present invention, the fastener elements 32 are substantially equally spaced along at least one of the end edge portions 19 and 21 and at least one of the side edge portions 23 and 25, for example, along both edge portions 19 and 25. Preferably, the fastener elements 32 are substantially equally spaced along all of the edge portions, i.e., along the entire perimeter of the curtain sheet 10. Thus, the spacing, illustrated at 38 in FIG. 2, is generally equal, for example, about 13 inches, between pairs of fastener elements 32 as well as between window frame fastener elements 30, i.e., an occasional fastener element may be left out resulting in double the width 38 between a pair of fastener elements or there may be another hole between a pair of fastener elements having the spacing 38. The present invention also does not exclude holes or fastener elements in the central portion (inside of the edge portions) of the curtain 10 as well as additional holes or fastener elements in the edge portions.

The window frame 14 is shown to have 5 equally spaced fastener elements 30 over its width, and the curtain sheet 10 is shown to have 3 equally spaced fastener elements 32 over its upper (as well as lower) edge portion 19 thus allowing two such sheets 10 to be hung side-by-side (with one fastener element 32 on each curtain sharing a common central fastener element 30 on the window frame 14), as illustrated in FIG. 1. The curtain sheet 10 is also shown to have 5 equally spaced fastener elements 32 along each of its side edge portions 23 and 25 whereby one of the side edge portions 23 and 25 may alternatively serve as the top of a single curtain extending across the entire width of the window.

Referring to FIG. 4, there is illustrated generally at 50 a template (an elongate sheet or cardboard or paper or other suitable material) or installation strip containing holes, illustrated at 52, having the spacing 38 for use by a customer in installing the fastener elements 30 so that they have the spacing corresponding to the spacing 38 of the fastener elements 32 in the curtains 10.

In accordance with the present invention, the equally spaced fastener elements 32 over the perimeter of the curtains 10 desirably allows the curtains 10 (or single curtain) to be hung in a multitude of alternative decorative/functional patterns of which the patterns shown in FIGS. 1 and 8 (described hereinafter) are but two examples. FIG. 2 illustrates how to achieve the left-hand side of the pattern of FIG. 1, the pattern for the right-hand side thereof being the mirror image thereof and therefore achieved similarly. The curtain is initially hung by inserting the three left-most window frame pins 51, 52, and 53 into the curtain upper edge portion holes 41, 42, and 43 respectively. Then pins 52 and 51 are inserted into side edge portion holes 44 and 45 respectively, as illustrated by arrows 1 and 2 respectively. As apparent in FIG. 2, this requires the previously discussed equal spacing 38 in order to effectively and aesthetically achieve the desired effect without excess material hanging around the window frame 14 in an unsightly manner. Finally, pins 52 and 51 are inserted into side edge portion holes 46 and 47 respectively, as illustrated by arrows 3 and 4 respectively. It is thus apparent that by connecting the fastener elements 30 and 32 in various other combinations, a multitude of alternative decorative/functional curtain patterns, in the nature of origami, may be desirably achieved. Similarly, another set of various alternative decorative curtain patterns may be achieved if one curtain 10 (or two side-by-side) is hung along one of its side edge portions 23 or 25 or if one panel is hung along an end edge and the other hung along a side edge. Two or more curtain sheets may be fully or partially stacked, i.e., hung from the same set of fastener elements 30 or sharing more than one fastener element 30 to achieve even more decorative/functional patterns.

Unequal spacing between fastener elements 32 as well as between fastener elements 30 may result in difficulty in connecting certain fastener elements 32 to certain fastener elements 30 and/or result in unsightly bunching of fabric when they are connected. Thus, the equal spacing between fastener elements 32 as well as between fastener elements 30, in accordance with the present invention as hereinbefore discussed, allows the desired connections to be easily made and allows the connections to be desirably "squared." However, it may sometimes be desirable to "skip" a hole or holes when hanging so as to achieve a draping or gathered effect. Thus, the equal spacing 38, while alleviating difficulty in connecting fastener elements so that connections may more easily be made and without unsightly "bunching," allows both a soft or gathered look and a "squared" look, as desired.

It may be difficult for a person hanging a curtain in one of the patterns to be able to readily identify a specific hole 32 needed for connection to a pin 30. In order to identify each hole, a tag system may be used such as illustrated in FIG. 7. As illustrated therein, a tag or flag 80 is clipped, by clip 82, to the position of each hole 32 so that it can be unclipped therefrom when the desired pattern is formed. Each tag 80 is coded with a number, signifying the position vertically of the hole and a letter signifying the position horizontally of the hole, i.e., a first nomenclature of identifiers. Thus, for example, the tag marked with "5C" signifies the fifth hole from the top edge (in this case, the bottom hole) and the third hole from the left edge. The tags 80 may be otherwise suitably coded such as by color-coding. The coding may be permanently applied such as by being sewn into the fabric. It should of course be understood that other suitable coding (and other suitable means for applying it such as by an adhesive or by discardable or re-usable stickers) may be provided to allow a person to be able to readily identify a hole 32 when arranging a pattern. Thus, referring to a set of instructions providing a view of the curtain showing which hole each coded tag should identify, a person may clip the tags 80 onto a curtain panel 10 before arranging it in a desired pattern. He or she may then refer to the sequence of connections (also provided in the instructions or otherwise) for the desired pattern (for example, for the panel of FIG. 2 wherein the connecter elements 30 and the upper panel connecter elements 32 would both have the code 1, the sequence may be 2C to 1B, 3C to 1A, 4C to 1B, and 5C to 1A, wherein a second nomenclature of identifiers 1A, 1B, 1C in this instance contains the number 1 followed by left to right consecutive letters to identify respective horizontal positions of the connector elements 30 from which the curtain is hung),check the coded tags 80 to locate the corresponding holes for each sequential connection, and follow the sequence of instructions using the respective identifiers. When the pattern is completed, the coded tags 80 may be removed and saved until needed again for arranging another pattern. Decorative accessories may be used to further enhance the pattern. Thus, the user may flip through a booklet or set of cards of pictures of patterns along with the sequence of fastener connections for each pattern and choose a desired pattern to be arranged. Users may also create their own patterns and record their own codes, i.e., sequence of fastener connections.

The codes as well as the fastener elements 32 may, for example, be positioned between the edge portions of a pair of layers of fabric sewn together along a line at a short distance from the edges thereof. Thus, the codes may be permanently sewed or printed or otherwise placed on the inside of an edge portion where it will be generally hidden from view, and the holes may be eyelets of loops sewn to one of the layers so that they are generally hidden from view between the edge portions of the layers. This permanent sewing or printing or otherwise placement of the codes on the fabric as well as the tags or flags 80 or stickers thus constitute identifier structures and are thusly referred to as such in the claims.

Figure 13:
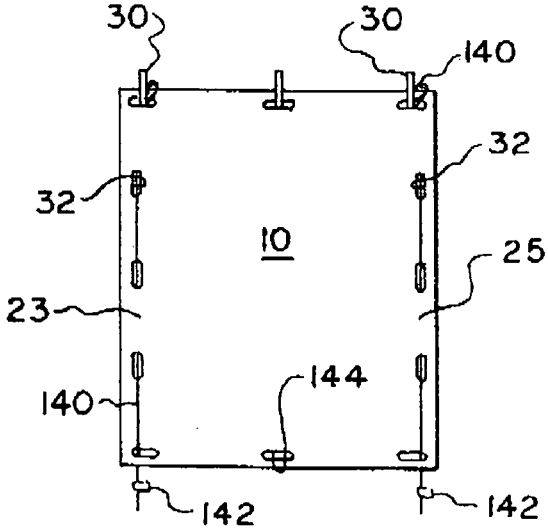
FIG. 13 is a plan view of a curtain panel illustrating an additional use thereof.

As illustrated in FIG. 13, for use similarly as a conventional Roman shade, a pair of strings or twine or ropes 140 may be threaded or laced through the holes 32 along each of the side portions 23 and 25 with their upper ends tied or otherwise suitably fastened to the respective hooks 30. The curtain panel 10 is bunched up toward the upper end thereby defining a Roman curtain like arrangement. The panel 10 may then be held in the Roman curtain like arrangement by applying clamps 142 or forming knots in the strings 140 or by threading through lower central hole 144 and tying the two strings 140 together or otherwise as suitable.

The curtains of the present invention may also be used as an educational toy for children. Thus, one or more panels may be fixed to a suitable surface such as, for example, a wall with one or a plurality of fixed clips marking the one or more fastener elements. This will allow a child to learn and practice skills such as colors, numbers, and visual concentration. The panels may be folded into animals or figures such as elephants or butterflies which may be more appealing to children. A web page may be provided to allow users to access additional codes to complete additional patterns.

Figure 5:
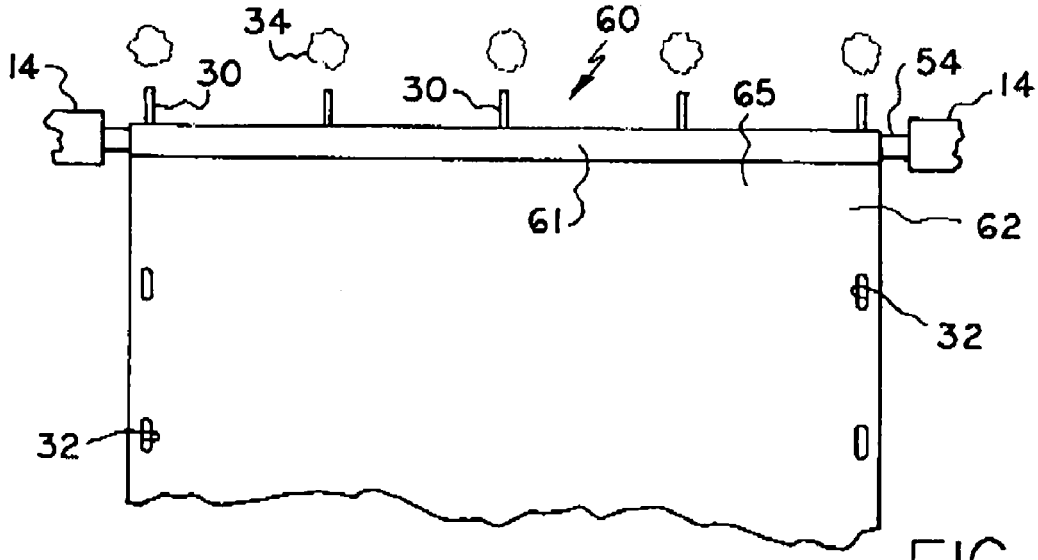
FIG. 5 is a partial side view of a curtain in accordance with another embodiment of the present invention.

Referring to FIG. 5, there is shown generally at 60 an alternative embodiment of the curtain wherein a curtain sheet or panel 62 is integrally, sewn, or otherwise suitably attached along its upper marginal portion 65 to a sleeve 61 (i.e., attached so that the sheet and sleeve are considered to be a single unit). As used in reference to the relation between the sheet 62 and sleeve 61 (as well as between the sheets 72 and sleeve 61 in FIG. 6) herein and in the claims, the term "attached" is meant to exclude the use of fastener elements 30 and 32 and is intended to refer to their being integral or sewn together or otherwise attached so that they are not separated during normal use. The sleeve 61 is received on curtain rod 54 which in turn is attached to the upper frame 14 and has the fastener elements 30 attached thereto. While shown as generally tubular in shape, it should be understood that the sleeve may be otherwise suitably embodied to receive rod 54, i.e., it may comprise a series of loops or tabs or ties (fabric strips that tie) or other eyelet formations for receiving the rod 54 and on which are received the fastener elements 30. Panel 62 is otherwise similar to panel 10 except that it of course need not have any fastener elements 32 along its upper marginal portion 65. The present invention does not require that the sleeve 61 be connected to the panel 62 as a single unit therewith in which event it would of course be necessary to have fastener elements 32 along the upper marginal portion 65. In order to arrange the curtain in a desired pattern, one or more of the fastener elements 32 as desired is raised and attached to one or more of the fastener elements 30 similarly as previously discussed with respect to FIGS. 1 to 3.

Figure 6:
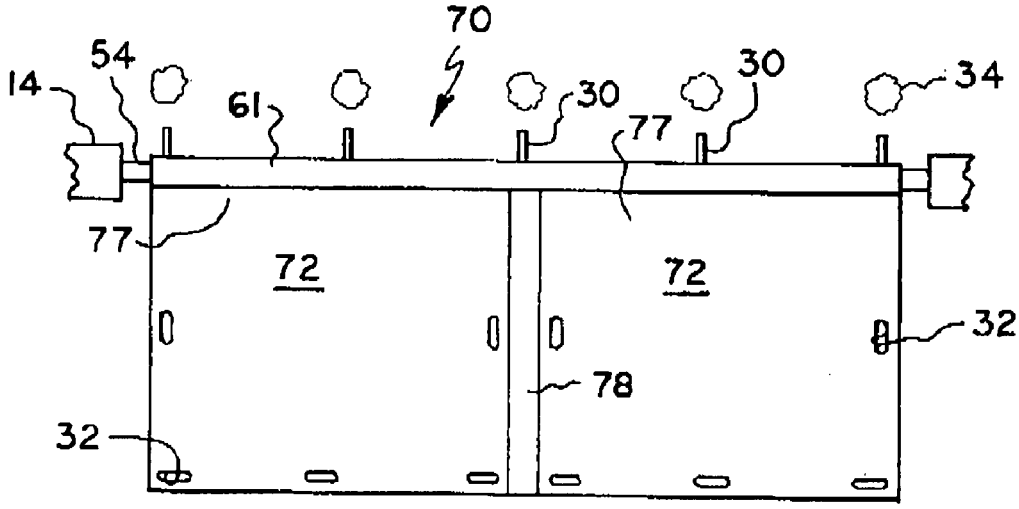
FIG. 6 is a side view of a curtain in accordance with another embodiment of the present invention.

Referring to FIG. 6, there is shown generally at 70 an alternative embodiment of the curtain wherein two curtain sheets 72 are integrally or otherwise suitably attached (as a unit) side-by-side along their respective upper marginal portions 77 to sleeve 61 which, like in FIG. 5, is received on curtain rod 54 which in turn is attached to the upper frame 14 and has the fastener elements 30 attached thereto. Curtain sheets 72 are otherwise similar to curtain sheet 62. In order to arrange the curtain in a desired pattern, one or more of the fastener elements 32 as desired are raised and attached to one or more of the fastener elements 30 similarly as previously discussed with respect to FIGS. 1 to 3. Behind the curtain sheets 72 (as well as behind curtain sheets 10 and 62) may be provided a sheer panel 78 (or panel of other suitable material and which may, if desired, be split) sewed or otherwise suitably attached to the sleeve 52 (or to fastener elements 30 or otherwise to the upper frame for the sheets 10).

Figure 10:
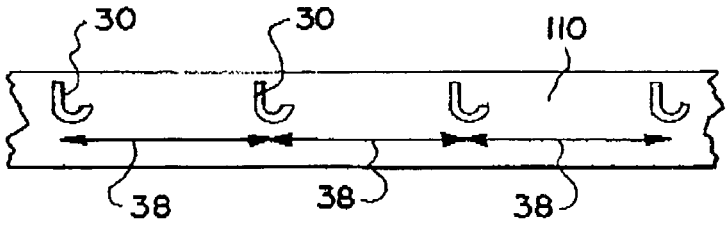
FIG. 10 is a side view of a header with fastener members attached for hanging of the curtains in accordance with another embodiment of the present invention.

Referring to FIG. 10, there is shown at 110 a header, made of wood, plastic, or other suitable material, which may be screwed or otherwise suitably attached to an upper window frame or other structural member and which supports the fastener members (hooks) 30 which may be molded thereto or screwed or otherwise suitably attached thereto. The header 110 may be suitably decoratively-shaped.

Figure 11:
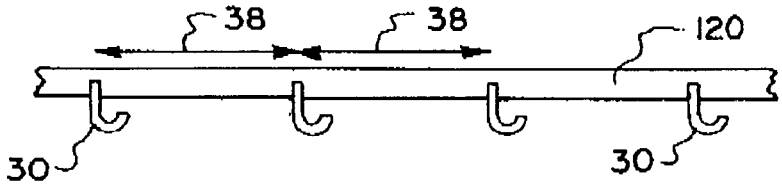
FIG. 11 is a view similar to that of FIG. 10 of a curtain rod with fastener members attached for hanging of the curtains in accordance with another embodiment of the present invention.

Referring to FIG. 11, there is shown at 120 a curtain rod, made of plastic or other suitable material and which may also be decoratively-shaped, which supports the fastener members (hooks) 30 which may be molded thereto or clamped or otherwise suitably attached thereto.

Figure 12:
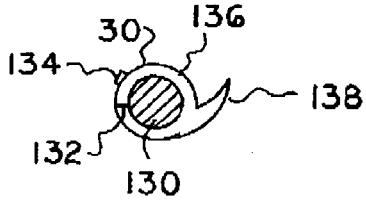
FIG. 12 is a cross-sectional view of a conventional curtain rod with fastener members attached for hanging of the curtains in accordance with another embodiment of the present invention.

Referring to FIG. 12, there is shown at 130 a conventional curtain rod on which the fastener members (hooks) 30 (one shown) are received, thereby transforming a conventional curtain rod for use with the curtains 10. The hooks 30 may be composed of plastic or other suitable material and have the form of clamps (split such as at 132) wherein they are slid over the length of the rod 130 into position then clamped in position such as by screw 134 or other suitable means. The hook portions 138 are formed (molded) integral with the clamp portions 136 or otherwise suitably attached thereto.

While the curtains themselves may be marketed, directions can also be sold, especially for the do-it-yourself person, on how to make a panel. This would desirably allow consumers to use the fabric of their choice. Such instructions may be marketed as a kit, a book, or a pattern.

Figure 8:
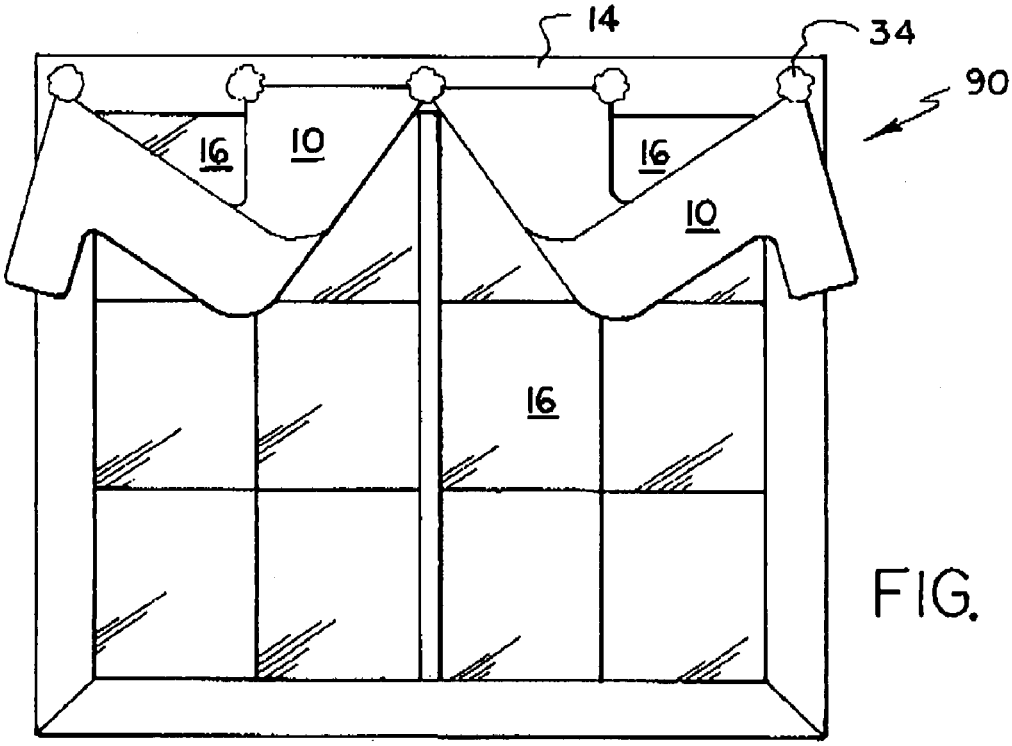
FIG. 8 is a view similar to that of FIG. 1 of the pair of curtain sheets arranged in an alternative pattern.
Figure 9:
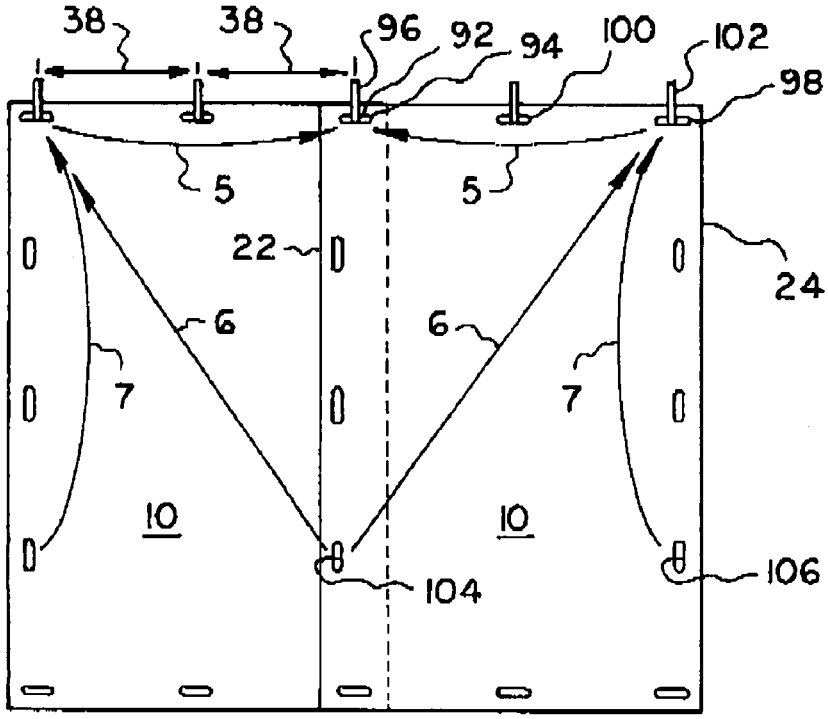
FIG. 9 is a plan view of the curtain sheets of FIG. 8.

FIG. 8 illustrates generally at 90 another example (a more exotic example) of one of the multitude of decorative/functional patterns that can be achieved with the curtains of the present invention. FIG. 9 illustrates the sequence involved in forming the pattern, beginning with the two panels being hung from pins 30 in an overlapping relation wherein the upper right hole 92 of the left panel and the upper left hole 94 of the right panel sharing the middle pin 96. The sequence for the right panel will now be described, it being understood that the sequence for the left panel is a mirror-image thereof. First, the panel is folded over itself to bring outer side edge 24 next to inner side edge 22, then pin 96 received in hole 94, as illustrated by arrow 5. As apparent in FIG. 9, if the spacing between holes 94, 98, and 100 were unequal, either the hole 98 could not reach the pin 96 for the pin 96 to be received therein or bunching would occur due to excess material. Thus, the equal spacing 38 is provided, as previously discussed, to effectively and aesthetically achieve the desired effect without excess material hanging around the window frame 14 in an unsightly manner. Finally, pin 102 is received in holes 104 and 106, in either order, as illustrated by arrows 6 and 7 respectively. It is thus apparent, as previously discussed, that by connecting the fastener elements 30 and 32 in various other combinations, a multitude of alternative decorative/functional curtain patterns, in the nature of origami, may be desirably achieved.

Accordingly, the fastener elements 32 are spaced along the perimeter of the curtain sheets, in accordance with the present invention as hereinbefore discussed, to effectively and aesthetically achieve a multitude of decorative/functional patterns in the nature of origami. The curtains of the present invention are provided to be therapeutic (relaxing, fun, satisfying, and exercising) and to inspire creativity in the user.

Once one becomes "hooked" with these curtains, he or she should never again be bored with the appearance of his or her curtains.

It should be understood that, while the present invention has been described in detail herein, the invention can be embodied otherwise without departing from the principles thereof, and such other embodiments are meant to come within the scope of the present invention as defined by the appended claims.

What is claimed is:

1. In combination, a curtain comprising a sheet of material having a sheet perimeter and a plurality of fastener elements spaced along and adjacent the sheet perimeter for connecting to respective mating fastener elements on a structural member for hanging one edge portion of said curtain sheet from the structural member, said plurality of fastener elements being positioned along and adjacent the sheet perimeter in a quantity and spacing over the entirety of the sheet perimeter for connecting to respective ones of the mating fastener elements for hanging other edge portions of said curtain sheet from the structural member so that the curtain can be hung from said structural member in a variety of alternative patterns, the combination further comprising a plurality of identifier structures attachable to said curtain for associating said identifier structures with the plurality of fastener elements respectively, said identifier structures containing identifiers of a first nomenclature which provide information identifying individual ones of the plurality of fastener elements respectively on the curtain, and means defining instructions identifying individual positions of the mating fastener elements respectively by a second nomenclature and containing steps for forming at least one of the alternative patterns wherein each step refers to said respective identifier of said first nomenclature and said respective identified individual position of the second nomenclature to direct a connecting of a corresponding one of said plurality of fastener elements with a corresponding one of said mating fastener elements.

2. A combination according to claim 1 wherein said plurality of fastener elements have generally equal spacings therebetween.

3. A combination according to claim 1 wherein said plurality of fastener elements are holes.

4. A combination according to claim 1 further comprising a plurality of mating fastener elements for attaching to the structural member and adapted for connecting to said plurality of fastener elements respectively on said sheet, and a template for locating positions for installing said second fastener elements on the structural member.

5. A combination according to claim 4 further comprising a plurality of clamps to which said mating fastener elements are attached respectively tar clampingly securing said mating fastener elements to a curtain rod.

6. A combination according to claim 4 wherein said mating fastener elements have spacings therebetween which are generally the same as the spacings between said plurality of fastener elements.

7. A combination according to claim 1 wherein said plurality of fastener elements are spaced entirely around the perimeter of said curtain sheet.

8. A combination according to claim 1 wherein said plurality of fastener elements are generally equally spaced over at least half of the perimeter of said curtain sheet.

9. A combination according to claim 1 wherein said sheet comprises at least two layers.

10. A combination according to claim 1 wherein said identifier structures are tags.

11. A method for hanging a generally rectangular curtain having a pair of end edge portions and a pair of side edge portions and a plurality of first fastener elements spaced along at least two adjoining ones of said end and side edge portions thereof from a structural member having a plurality of spaced second fastener elements which connectively mate with the first fastener elements, the method comprising:

(a) applying to the first fastener elements identifiers respectively of a first nomenclature so that each of the first fastener elements is identified; and (b) while following a plurality of steps each utilizing the first nomenclature to identity one of the first fastener elements and a second nomenclature identifying the second fastener elements, so that each of the second fastener elements is identified, to identify one of the second fastener elements for connecting of the one of the first fastener elements thereto, successively hanging a plurality of the edge portions of the curtain from the structural member thereby folding the curtain at least once over Itself to tuna a hanging curtain pattern.

wherein the step of hanging a plurality of the edge portions includes, at least, connecting at least one of the first fastener elements on one of said end and side edge portions of the curtain to one of the second fastener elements, and connecting at least one of the first fastener elements on an adjoining one of said end and side edge portions of the curtain to one of the second fastener elements.

12. A method according to claim 11 further comprising selecting the curtain to be composed of at least two layers.

13. A method according to claim 11 further comprising selecting the curtain to be linerless on both of opposite sides thereof.

14. A method according to claim 11 wherein the structural member is an upper window frame portion or structure associated therewith in a manner so that the curtain when hung therefrom hangs downwardly therefrom along the window.

15. A method according to claim 11 further comprising selecting the curtain to have the plurality of fastener elements spaced entirely around the perimeter of the curtain.

16. A method according to claim 11 further comprising selecting the curtain to have generally equal spacings between the plurality of fastener elements.

17. A method according to claim 11 further comprising selecting the plurality of fastener elements to be holes in the curtain.

18. In combination, a curtain comprising a sheet of material, having a sheet perimeter and a plurality of fastener elements spaced along and adjacent the sheet perimeter for connecting to respective mating fastener elements on a structural member for hanging one edge portion of said curtain sheet from the structural member, said plurality of fastener elements being positioned along and adjacent the sheet perimeter in a quantity and spacing over the entirety of the sheet perimeter for connecting to respective ones of the mating fastener elements for hanging other edge portions of said curtain sheet from the structural member so that the curtain can be hung from said structural member and folded over itself in a variety of alternative patterns whereby portions of both sides of said curtain sheet are viewable from one direction, wherein said sheet comprises at least two layers, the combination further comprising a plurality of decorative covers attachable to said curtain sheet for decoratively covering said plurality of fastener elements respectively, and means for instructing the hanging of the curtain in at least one of the patterns in a plurality of stops each directing a connecting of one of said plurality of fastener elements with one of said mating fastener elements, said instructing means containing identification of individual positions of said plurality of fastener elements respectively by a first nomenclature and individual positions of the mating fastener elements respectively by a second nomenclature for the directing of the connecting of one of said plurality of fastener elements with one of said mating fastener elements.

19. A combination according to claim 18 further comprising a plurality of identifier structures attachable to said curtain for positioning to associate with said plurality of fastener elements respectively and containing means for identifying individual positions thereof by said first nomenclature.

20. A combination according to claim 18 wherein said curtain is linerless on both of opposite sides thereof.

* * * * *